US008422929B2

(12) United States Patent
Tomono et al.

(10) Patent No.: US 8,422,929 B2
(45) Date of Patent: Apr. 16, 2013

(54) FIXING DEVICE AND IMAGE FORMING APPARATUS WITH A LUBRICANT AGENT HAVING A SAME COMPONENT AS THAT OF THE FIXING LIQUID

(75) Inventors: Hidenori Tomono, Kanagawa (JP); Takuma Nakamura, Kanagawa (JP); Yukimichi Someya, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 120 days.

(21) Appl. No.: 13/105,340

(22) Filed: May 11, 2011

(65) Prior Publication Data

US 2011/0280635 A1 Nov. 17, 2011

(30) Foreign Application Priority Data

May 14, 2010 (JP) ..... 2010-112132

(51) Int. Cl.
*G03G 15/20* (2006.01)

(52) U.S. Cl.
USPC ..... 399/327

(58) Field of Classification Search ..... 399/327, 399/340, 124.1, 249
See application file for complete search history.

(56) References Cited

U.S. PATENT DOCUMENTS

| | | | |
|---|---|---|---|
| 7,655,374 | B2 | 2/2010 | Katano et al. |
| 7,713,673 | B2 | 5/2010 | Katano et al. |
| 7,773,932 | B2 | 8/2010 | Katano et al. |
| 7,794,835 | B2 | 9/2010 | Katano et al. |
| 7,813,689 | B2 | 10/2010 | Nakamura et al. |
| 7,869,754 | B2 | 1/2011 | Katano et al. |
| 2007/0098469 | A1 | 5/2007 | Yoshino et al. |
| 2007/0243483 | A1 | 10/2007 | Katano et al. |
| 2009/0003903 | A1 | 1/2009 | Katano et al. |
| 2009/0067904 | A1 | 3/2009 | Katano et al. |
| 2011/0255896 | A1* | 10/2011 | Kim ..... 399/101 |

FOREIGN PATENT DOCUMENTS

| | | |
|---|---|---|
| EP | 1 780 608 A2 | 5/2007 |
| EP | 1 780 608 A3 | 5/2007 |
| JP | 58-115468 | 7/1983 |
| JP | 5-341624 | 12/1993 |
| JP | 4302700 | 5/2009 |
| JP | 2010-156908 | 7/2010 |

OTHER PUBLICATIONS

Extended European Search Report issued Aug. 12, 2011, in Patent Application No. 11165435.6.

* cited by examiner

*Primary Examiner* — Walter L Lindsay, Jr.
*Assistant Examiner* — Billy J Lactaoen
(74) *Attorney, Agent, or Firm* — Oblon, Spivak, McClelland, Maier & Neustadt, L.L.P.

(57) ABSTRACT

A disclosed fixing device includes a fixing material application unit applying a fixing material to a fixing material carrier, a transfer unit transferring the fixing material onto a recording medium, a cleaning blade cleaning the fixing material carrier after the fixing material is transferred onto the recording medium, and a lubricant agent application unit disposed on a downstream side of the cleaning blade on the fixing material carrier and applying a lubricant agent to the fixing material carrier. Further, before a fixing operation is started, the lubricant agent application unit applies the lubricant agent to the fixing material carrier, and the fixing material carrier moves in a direction opposite to a direction when the fixing operation is performed and to a position where the applied lubricant agent is adhered to the cleaning blade.

2 Claims, 6 Drawing Sheets

FIXING DEVICE AND IMAGE FORMING APPARATUS WITH A LUBRICANT AGENT HAVING A SAME COMPONENT AS THAT OF THE FIXING LIQUID

CROSS-REFERENCE TO RELATED APPLICATIONS

The present application claims priority under 35 U.S.C §119 to Japanese Patent Application No. 2010-112132 filed May 14, 2010, the entire contents of which are hereby incorporated herein by reference

BACKGROUND OF THE INVENTION

1. Field of the Invention

The present invention generally relates to a fixing device used in an image forming apparatus such as a copier, a facsimile machine, a printer and the like. More particularly, the present invention relates to a fixing device and an image forming apparatus including the fixing device, the fixing device fixing resin particles onto a recording medium by applying a foam-like fixing material to the resin particles, the foam-like fixing material being capable of dissolving or swelling the resin particles including toner.

2. Description of the Related Art

It is known that image forming apparatuses such as a printer, a facsimile machine, a copier, an MFP (Multi-Function Peripheral) and the like form images including characters and symbols onto a recording medium such as a sheet, fibers, an OHP sheet and the like based on image information. Among the image forming apparatuses, an electrophotographic-type image forming apparatus has been widely used because a high-resolution image using resin-containing particles can be formed onto a regular paper. The resin-containing particles refer to particles containing resin as one of the components. Further, the toner refers to the resin-containing particles used in the electrophotographic-type image forming apparatus, and contains materials that can develop (express) necessary functions for the electrophotographic-type image forming apparatus, the materials including a charge controlling agent that develops the charging performance in the resin-containing particles, a color material that expresses a color, and a material that prevents the particles from being adhered to each other.

In such an electrophotographic-type image forming apparatus, the fixing speed is fast and the fixed image quality is high. Because of the features, a heat fixing method is widely used, where toner on the recording medium is heated to dissolve the toner and the dissolved toner is pressed to fix the toner onto the recording medium. The image forming apparatuses such as a printer, a facsimile machine, a copier, an MFP and the like using the heat fixing method form images including characters and symbols onto a recording medium such as a sheet, fibers, an OHP sheet and the like based on image information. Among the image forming apparatuses, an electrophotographic-type image forming apparatus has been widely used because a high-resolution image using resin-containing particles can be formed onto a regular paper.

In the electrophotographic-type image forming apparatuses, more than half of the energy supplied is consumed by heating toner. Therefore, it is not easy to greatly reduce the consumption of energy of such image forming apparatuses for energy conservation.

From the viewpoint of addressing recent environmental problems, it has been desired to provide a fixing device requiring less energy consumption (an energy-saving fixing device), which is namely, a fixing device using a non-heating fixing method in which toner is fixed without heating the toner.

As an example of the non-heating fixing method, there is a wet fixing method in which toner is softened by adhering an organic solvent capable of dissolving or swelling toner to the toner. For example, there is a known wet fixing method in which a fixing liquid is generated in a foam, and the generated foam-like fixing liquid is applied to resin particles on a recording medium while the film thickness of the generated foam-like fixing liquid is controlled to fix the resin particles onto the recording medium (see, for example, Japanese Patent No. 4302700, hereinafter "Patent Document 1"). Herein, the term "foam-like" generally refers to a foam state. However, according to a more strict expression, the term "foam-like" refers to a continuous body where plural air grains (air bubbles) surrounded by liquid films are integrated with the liquid films.

According to Patent Document 1, by making the fixing liquid into foam and applying the fixing liquid to a recording medium on which an image using resin-containing particles (hereinafter a unfixed toner image T) is formed, unfixed resin-containing particles can be fixed without being offset to the fixing material side or without disturbing the positions of the unfixed resin-containing particles. Further, the foam-like fixing material contains a large amount of air bubbles. Therefore, the volume of the fixing liquid is smaller than the volume of the foam-like fixing material. As a result, the amount of the liquid applied to the recording medium is reduced. Further, without causing a change when touching the recording medium and without undulating the recording sheet, it becomes possible to fix the image without degrading the fixing capability and the fixing quality.

The foam-like fixing material as described in Patent Document 1 is carried onto the surface of the application roller and then applied to a sheet. However, after being applied to the sheet, some of the foam-like fixing material may remain on the application roller. Further, besides the residue of the fixing material, for example, a part of toner, and paper powder that was on the sheet may also be adhered to the application roller. Because of this feature, it is preferable to clean the application roller before the next fixing material is applied to the surface of the application roller.

As a technique of cleaning the application roller, there is a technique in which the application roller is cleaned by bringing a cleaning blade into contact with the surface of the application roller. In this case, to enhance the cleaning performance, the cleaning blade is required to be in contact with the application roller in a manner such that the touching end of cleaning blade faces the moving direction of the application roller (i.e., in a so-called counter blade manner) which is the fixing material carrier.

On the other hand, though it is not a known technique to clean the application roller using the cleaning blade, there is a known technique to clean the toner and the paper powder adhered to a photosensitive body, the charging roller and the like using the cleaning blade. In this technique, while no image is being formed, by rotating the photosensitive body in the reverse direction, the toner and foreign particles remaining at the distal end of the cleaning blade are removed from the end of the blade (see, for example, Japanese Patent Application Publication No. 05-341624, hereinafter "Patent Document 2").

Further, as the configuration to clean the photosensitive body, there is known another technique in which a non-volatile lubricant liquid is applied to a point on the surface of the photosensitive body, the point being disposed on the upstream side or the downstream side of the cleaning blade which is in contact with the photosensitive body (see, for example, Japanese Patent Application Publication No. 58-115468, hereinafter "Patent Document 3").

However, in Patent Document 1, in a case where the cleaning blade is in contact with the application roller in the counter blade manner, if the frictional resistance to sliding the cleaning blade on the surface of the application roller is high, the contact edge of the cleaning blade may be bent (folded) by the rotation of the application roller, the contact edge being disposed closer to (or being in contact to) the application roller. When the contact edge of the cleaning blade is bent (folded) by the rotation of the application roller, the cleaning performance may be degraded.

In other words, in the fixing device using the foam-like fixing material, while the apparatus is continuously used, the surface of the application roller and the surface of the cleaning blade are sufficiently wetted by the foam-like fixing material, and therefore the frictional resistance to sliding the cleaning blade on the surface of the application roller is low. As a result, the contact edge of the cleaning blade may not be bent (folded) by the rotation of the application roller. However, when the apparatus is used intermittently, or just after the apparatus has started operating, due to dried fixing material or the adhesion of the paper powder and the like, there may be a case where the fixing material having viscosity higher than a normal value remains on the surface of the application roller. In such a case, the frictional resistance to sliding the cleaning blade on the surface of the application roller is high. As a result, when the application roller rotates in the direction so that the application roller collides with the cleaning blade, it may be more likely to bend (fold) the contact edge of the cleaning blade by the rotation of the application roller.

Further, the technique of Patent Document 2 is to remove foreign matter adhered to the cleaning blade after cleaning. More specifically, the technique is to remove foreign matter from the cleaning blade by rotating the photosensitive body or the like in the reverse direction, the foreign matter having been adhered during the image forming operations. Because of this feature, this technique cannot be applied to the cleaning blade and the application roller to prevent the bending (folding) of the contact edge of the cleaning blade due to the rotation of the application roller. Namely, in order to prevent the bending (folding) of the contact edge of the cleaning blade due to the rotation of the application roller, it is required to make the frictional resistance to sliding the cleaning blade on (against) the surface of the application roller sufficiently high. However, again, the technique of Patent Document 2 is to remove foreign matter from the cleaning blade by rotating the photosensitive body or the like in the reverse direction. Therefore, it is not feasible to apply the technique to the cleaning blade and the application roller to prevent the bending (folding) of the contact edge of the cleaning blade due to the rotation of the application roller.

Further, in the technique described in Patent Document 3, a non-volatile lubricant liquid is used. This feature is not preferable due to safety concerns.

On the other hand, in a case where water having an advantage in the safety point of view is used as a main component of the fixing liquid and the lubricant liquid, while the apparatus is stopped, water content of the fixing liquid and the lubricant liquid remaining on the fixing material carrier such as the application roller gradually vaporizes. As a result, the components other than water are condensed, which may impede (increase the frictional resistance of) the sliding of the cleaning blade on the application member (i.e., application roller). Further, solid content may be precipitated, which may cause adhesion between the cleaning blade and the fixing material carrier. Therefore, it is desirable to apply the lubricant agent just before the fixing is started.

SUMMARY OF THE INVENTION

The present invention is made in light of the above circumstances, and may provide a fixing device and an image forming apparatus including the fixing device, the fixing device being capable of forming stable and favorable images by preventing the bending (folding) of the contact edge of the cleaning blade that cleans the fixing material carrier when the fixing material carrier moves, the contact edge being displaced closer to the fixing material carrier and by maintaining excellent cleaning performance for a long term.

According to an aspect of the present invention, there is provided a fixing device applying a fixing liquid to resin particles formed on a recording medium to fix the resin particles to the recording medium, the fixing liquid containing softener that softens resin-containing particles by dissolving or swelling at least a part of the resin, the resin particles being formed on the recording medium based on image information of an image to be formed. The fixing device includes a fixing material application unit that applies a fixing material made of the fixing liquid to a fixing material carrier, a transfer unit that transfers the fixing material onto the recording medium on which the resin particles are formed, the fixing material having been applied to the fixing material carrier by the fixing material application unit, a cleaning blade that cleans the fixing material carrier after the fixing material is transferred onto the recording medium by the transfer unit, and a lubricant agent application unit that is disposed on a downstream side of the cleaning blade on the fixing material carrier and that applies a lubricant agent to the fixing material carrier. Further, before a fixing operation is started, the lubricant agent application unit applies the lubricant agent to the fixing material carrier, and the fixing material carrier moves in a direction opposite to a direction when the fixing operation is performed and to a position where the applied lubricant agent is adhered to the cleaning blade.

By having this configuration, it may become possible to reduce the frictional resistance to sliding the cleaning blade on the surface of the application roller when the fixing operation is started. As a result, the contact edge of the cleaning blade may not be bent (folded) by the rotation of the application roller, the contact edge being displaced closer to the fixing material carrier, and excellent cleaning performance may be maintained for a long time period, thereby enabling forming excellent images stably.

Further, according to an aspect of the present invention, the lubricant agent has the same component of that of the fixing liquid.

By having this feature, no extra component of the lubricant agent may be applied to the fixing material carrier. As a result, an excellent fixing performance may be maintained.

Further, according to an aspect of the present invention, the lubricant agent application unit and the fixing material application unit are the same device, and in a refresh operation to remove a remaining fixing material in the fixing material application unit, the fixing material removed by the refresh operation is applied to the fixing material carrier as the lubricant agent and the fixing material carrier moves in the direction opposite to the direction when the fixing operation is performed.

By having this configuration, since it is no longer necessary to separately provide the lubricant agent application unit, it may become possible to reduce the cost of the fixing device and improve the degree of freedom regarding the layout of, for example, the cleaning blade and the fixing material application unit.

According to an aspect of the present invention, there is provided an image forming apparatus including an electrostatic latent image forming unit that forms an electrostatic latent image on an electrostatic latent image carrier, a development unit that develops the electrostatic latent image formed on the electrostatic latent image carrier using a developer containing resin-containing particles to form a resin-containing particle image, a transfer unit that transfers the resin-containing particle image formed on the electrostatic latent image carrier onto a recording medium, and the fixing unit that fixes the resin-containing particle image to the recording medium, the resin-containing particle image having been transferred onto the recording medium as described above.

By having this configuration, in the image forming apparatus including the above fixing device, it may become possible to reduce the frictional resistance to sliding the cleaning blade on the surface of the application roller when the fixing operation is started. As a result, the contact edge of the cleaning blade may not be bent (folded) by the rotation of the application roller, the contact edge being displaced closer to the fixing material carrier, and excellent cleaning performance may be maintained for a long time period, thereby enabling forming excellent images stably.

According to an aspect of the present invention, in the fixing device and the image forming apparatus which use foam-like fixing material, it may become possible to prevent the contact edge of the cleaning blade that cleans the fixing material carrier from being bent (folded) by the rotation of the application roller, the contact edge being displaced closer to the fixing material carrier. Further, it may become possible to maintain an excellent cleaning performance for a long time period. As a result, a fixing device capable of forming stable and excellent images and an image forming apparatus including the fixing device may be provided.

BRIEF DESCRIPTION OF THE DRAWINGS

Other objects, features, and advantages of the present invention will become more apparent from the following description when read in conjunction with the accompanying drawings, in which.

DETAILED DESCRIPTION OF THE PREFERRED EMBODIMENTS

In the following, an embodiment of the present invention is described with reference to the accompanying drawings.

Figure 1:
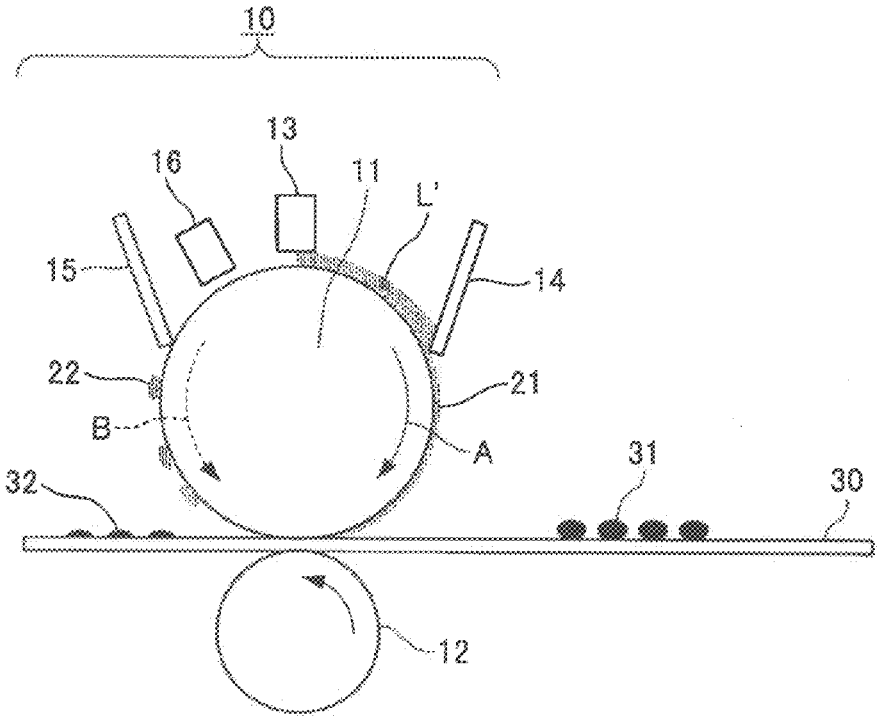
FIG. 1 is a drawing illustrating an example configuration of a fixing device according to an embodiment of the present invention.

First, an example configuration is described with reference to FIG. 1. FIG. 1 schematically illustrates a configuration of a fixing device 10 according to an embodiment of the present invention.

As illustrated in FIG. 1, the fixing device 10 includes an application roller 11, a backup roller 12, a fixing material application device 13, an application blade 14, a cleaning blade 15, and a lubricant agent application device 16. The application roller 11 is a fixing material carrier. The backup roller 12 biases (presses) a recording medium 30 toward the fixing material carrier (application roller 11). The fixing material application device 13 applies a foam-like fixing material L' to the application roller 11. The application blade 14 smoothes the foam-like fixing material L' so that the foam-like fixing material L' on the application roller 11 has a uniform thickness. The cleaning blade 15 removes unnecessary objects (foreign matter) including fixing material 22 and paper powder (not shown) transferred from the recording medium 30, the fixing material 22 remaining on the application roller after the foam-like fixing material L' is transferred onto the recording medium 30. Herein, the foam-like fixing material L' refers to a material which is prepared by bubbling a liquid-like fixing liquid by using a foam-like fixing material generator 110 described below with reference to FIG. 2 so as to have minute (fine) bubbles, the liquid-like fixing liquid containing softener to soften resin.

In the fixing device 10 having the above configuration, a "fixing operation" is performed as described below.

Figure 2:
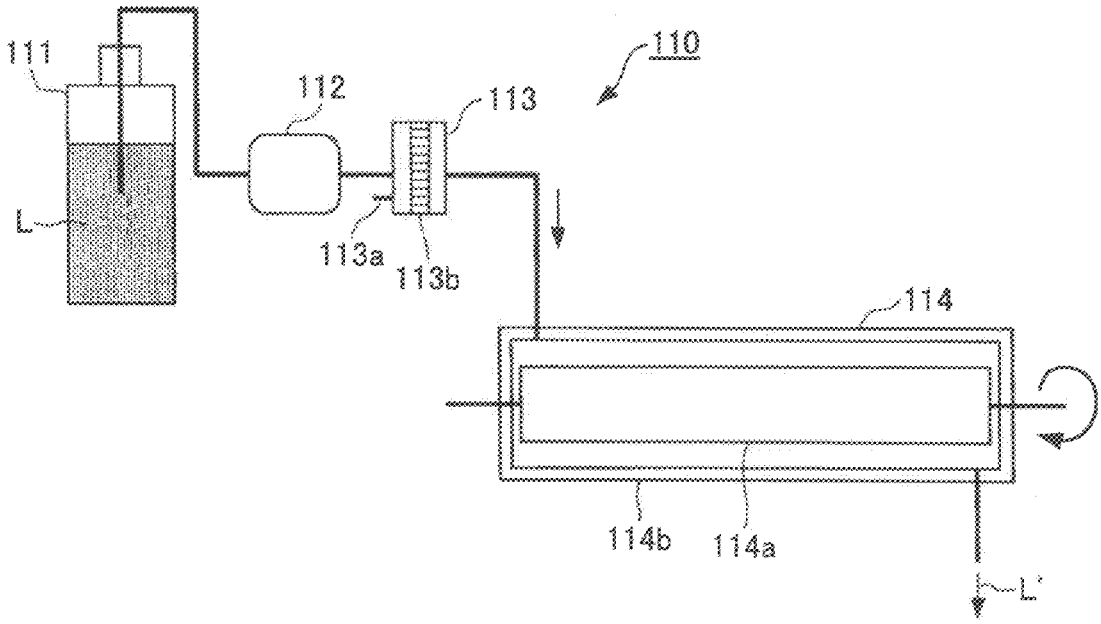
FIG. 2 is a drawing illustrating an example configuration of a foam-like fixing material generator according to an embodiment of the present invention.

While the application roller 11 is rotated in the A direction indicated in FIG. 1, the foam-like fixing material L' generated by the foam-like fixing material generator 110 of FIG. 2 is applied to the application roller 11 by the fixing material application device 13. Further, by the application blade 14, the foam-like fixing material L' is smoothed, so that a uniform foam film 21 (having a uniform thickness) (of the foam-like fixing material L') is formed on the application roller 11.

Next, the formed foam film 21 is applied to the recording medium 30, on which there is an unfixed image made of resin-containing particles, in a nip section (i.e., a contacting part between the application roller 11 and the backup roller 12). The resin-containing particles are softened by the applied foam-like fixing material L' and then fixed onto the recording medium 30 by the pressure applied to the nip section.

On the other hand, however, on the application roller 11 after the application, there may be remaining unnecessary objects (foreign matter) including the fixtuing material that could not be applied to the recording medium 30 and paper powder (not shown) transferred from the recording medium 30. Therefore, after removing the unnecessary objects from the application roller 11 by using the cleaning blade 15, a series of the fixing operations is completed. To that end, the cleaning blade 15 is disposed in a so-called counter manner (in counter attack) as illustrated in FIG. 1 against the application roller 11 that rotates in the normal direction (the A direction) while the fixing operation is performed. Namely, the cleaning blade 15 is in contact with the application roller 11 in the counter manner during the fixing operation. Further, when the application roller is rotated in the direction (the B direction) opposite to the normal direction while the fixing operation is performed, the cleaning blade 15 is in contact with the application roller 11 in so-called a trailing manner.

Figure 4A:
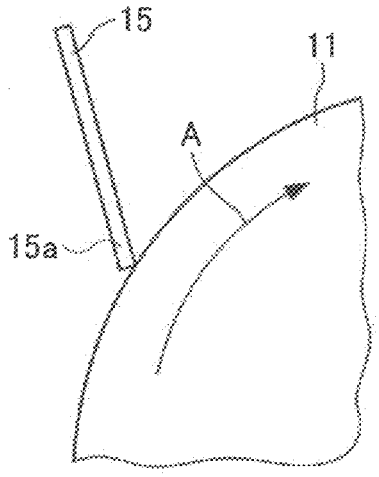
FIGS. 4A and 4B are drawings illustrating a case where a contact edge of a cleaning blade is bent (folded) when an application roller rotates in an A direction, the contact edge being disposed closer to the application roller.
Figure 4B:
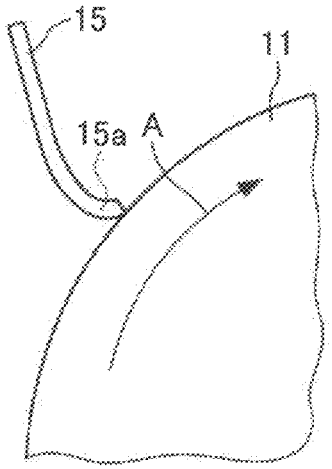

In the above fixing operation, as illustrated in FIG. 4A, there may be a case where a contact edge 15*a* of the cleaning blade 15 is bent (folded) when an application roller 11 rotates in the A direction as illustrated in FIG. 4B, the contact edge 15*a* of the cleaning blade 15 being disposed closer to (in contact with) the application roller. Namely, during the fixing operation, the cleaning blade 15 is in a shape as illustrated in FIG. 4A. However, due to an excessive frictional force between the contact edge 15*a* of the cleaning blade 15 and the application roller 11, the contact edge 15*a* of the cleaning blade 15 may be bent by the rotation of the application roller 11 as illustrated in FIG. 4B. As a result, a desired cleaning performance may not be obtained.

Figure 5:
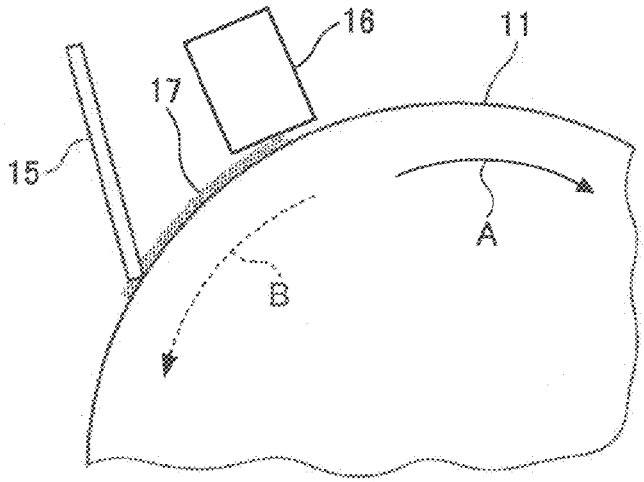
FIG. 5 is a drawing illustrating an example operation of a lubricant agent application unit and the application roller according to an embodiment of the present invention.

To resolve the problem, according to an embodiment of the present invention, an operation herein called a "cleaning blade bending preventing operation" as schematically illustrated in FIG. 5 is performed. In the "cleaning blade bending preventing operation", the lubricant agent application device 16 that applies a lubricant agent 17 to the application roller 11 is provided (disposed) on the application roller 11 and on the downstream side of the cleaning blade 15 when the application roller rotates in the A direction of FIG. 5. Further, in the "cleaning blade bending preventing operation", the lubricant agent 17 is applied from the lubricant agent application device 16 to the application roller 11, and the application roller 11 rotates in the B direction which is the direction opposite to the rotational direction (A direction) while a fixing operation is performed. In order to deliver the lubricant agent 17 to a contact point between the cleaning blade 15 and the application roller 11, the application 11 rotates in the B direction by at least a distance between the lubricant agent application device 16 and the contact point which is between the cleaning blade 15 and the application roller 11 along the circumference of the application roller 11. Namely, the rotation amount of the application roller 11 in the B direction is equal to or greater than the distance between the lubricant agent application device 16 and the contact point which is between the cleaning blade 15 and the application roller 11. By doing in this way, it may become possible to apply (deliver) the lubricant agent 17 to the contact point between the cleaning blade 15 and the application roller 11. Further, the description that "the lubricant agent application device 16 is provided (disposed) on the application roller 11 and on the "downstream side" of the cleaning blade 15" means that the position of the lubricant agent application device 16 is on the A (rotational) direction side of the cleaning blade 15, the A direction being the rotational direction while the fixing operation is performed.

Further, when the application roller 11 rotates in the B direction, the cleaning blade 15 is in contact with the application roller 11 in the trailing manner. Therefore, the contact edge 15*a* of the cleaning blade 15 cannot be bent (folded) by the rotation of the application roller 11.

After the lubricant agent 17 is applied to the contact point between the cleaning blade 15 and the application roller 11, even when the application roller 11 rotates in the A direction (i.e., the direction while the fixing operation is performed), due to the lubricant agent 17 applied to the contact point between the cleaning blade 15 and the application roller 11, it may become possible to prevent the bending (folding) of the contact edge 15*a* of the cleaning blade 15.

The lubricant agent application device 16 may have a configuration such that a liquid of the lubricant agent 17 is dropped little by little onto the surface of the application roller. Further, the lubricant agent application device 16 may have another configuration such that the lubricant agent application device 16 is provided so as to be in contact with the application roller 11. In this configuration, in order to apply the lubricant agent 17 to the application roller 11, the lubricant agent application device 16 is in contact with the application roller 11 and the lubricant agent 17 is exuded from the inside of a sponge-like porous body of the lubricant agent application device 16. Further, as described below, when the foam-like fixing material L' is used as the lubricant agent 17, the lubricant agent application device 16 may have the same configuration as that of the fixing material application device 13.

The bending (folding) of the contact edge 15*a* of the cleaning blade 15 may occur due to the increase of the slide resistance between the application roller 11 and the cleaning blade 15 caused by the increase of the viscosity of the fixing material on the application roller due to the drying of the fixing material or the adhesion of paper powder and the like to the fixing material. Because of this feature, it is preferable to perform the "cleaning blade bending preventing operation" before the "fixing operation" is performed when the fixing device 10 or an image forming apparatus 200 (see FIG. 8) having the fixing device 10 is started to operate and when the fixing operation is to be performed after a certain time period has passed since the last fixing operation has been performed. Further, the "cleaning blade bending preventing operation" may be performed each time before the fixing operation is performed. However, in such a case, the lubricant agent 17 may be consumed (used) more than necessary, which is not preferable. Further, it may be desirable to monitor the temperature and the humidity and determine an appropriate time interval between adjacent fixing operations to perform the "cleaning blade bending preventing operation" based on the temperature and humidity.

As the lubricant agent 17, it is preferable to use a material that can improve (lower the frictional resistance to) the sliding of the cleaning blade 15 on the application roller 11. Further, it may be necessary that the material does not contain any component that degrades the application roller 11 and the cleaning blade 15 when the material is applied to the application roller 11 and the cleaning blade 15. Further, it may also be necessary that the application of the lubricant agent 17 to the application roller 11 does not hinder the application of the fixing material to the application roller.

When the lubricant agent 17 is made of any of the fixing material, the fixing liquid, and a part of the fixing material or the fixing liquid, the conditions described above as the lubricant agent 17 may be satisfied. Therefore, the lubricant agent 17 may have the same components as those in the fixing liquid. Further, as long as the above conditions are satisfied as the lubricant agent 17, any appropriate material may be used as the lubricant agent 17.

Figure 7:
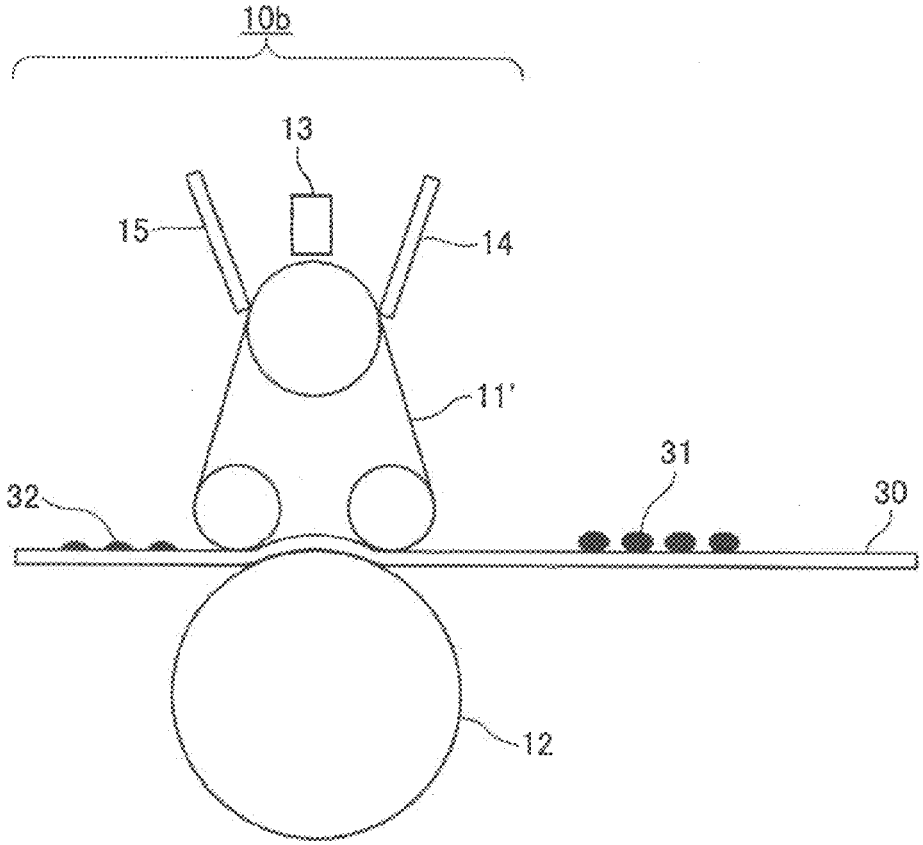
FIG. 7 is s drawing illustrating still another example configuration of the fixing device according to an embodiment of the present invention.

When the foam-like fixing material L' is used as the lubricant agent 17, the fixing material application device 13 may be used as a substitute for the lubricant agent application device 16. Namely, as illustrated in FIG. 7, the fixing material application device 13 may be used as a substitute for the lubricant agent application device 16 without (separately) providing the lubricant agent application device 16. In other words, the lubricant agent application device 16 and the fixing material application device 13 may be the same device (in this embodiment, both are aggregated into a single fixing material application device 13).

In this case, it is not necessary to separately provide the lubricant agent application device 16. Because of this feature, it may become possible to reduce the cost of the device. Further, because the lubricant agent application device 16 is not provided, it may become possible to improve the degree of freedom regarding the layout of, for example, the cleaning blade 15 and the fixing material application device 13.

The characteristics of the foam-like fixing material L' such as bubbles may be changed as time elapses. In this case, an appropriate application amount may be changed, and a toner offset preventing effect may also be degraded. Because of this feature, it may not possible to use the foam-like fixing material L' for the next fixing operation, for example, if the foam-like fixing material L' remaining in the fixing material application device 13 after the completion of the fixing operation (last fixing operation) and the time interval between those two fixing operations is too long.

A time period until the characteristics of the generated foam-like fixing material L' are changed varies depending on, for example, the preparation method of the fixing material and environmental conditions such as the temperature and the humidity. Because of this feature, it may be necessary to determine a permitted time interval between the adjacent fixing operations (permitted time period) depending on the preparation method and the environmental conditions. Therefore, when the time interval until the next fixing operation exceeds the permitted time period, it may be necessary to remove (purge) the fixing material remaining in the fixing material application device 13. Namely, it is necessary to perform a "refresh operation" to refresh the fixing material application device 13. The fixing material consumed in the refresh operation may be used as the lubricant agent 17. Namely, in the refresh operation to remove the fixing material remaining in the fixing material application device 13, the fixing material removed in the refresh operation may be applied to the application roller 11 as the lubricant agent 17, and at the same time, the application roller is rotated (moved) in the direction opposite to the rotational (moving) direction while the fixing operation is performed. In this case, as effect of this embodiment of the present invention, it is not necessary to separately provide the lubricant agent application device 16. Therefore, it may become possible to reduce the cost of the device, and it may become possible to improve the degree of freedom regarding the layout of, for example, the cleaning blade 15 and the fixing material application device 13. In addition to the above effects, there may be another effect that the remaining fixing material that may not be used in the fixing operation may be used as the lubricant agent 17.

Further, in the above description, with reference to FIG. 1, a case is described where the fixing liquid is mixed with air to generate foam-like fixing material and the foam-like fixing material is used. However, for example, the fixing liquid may be directly used in the liquid state. Further, in the above description, with reference to FIG. 1, a case is described where the application roller 11 is used as the fixing material carrier. However, for example, a belt or the like may also be used as the fixing material carrier.

Next, an example configuration of the foam-like fixing material generator 110 is described with reference to FIGS. 2, 3A, 3B, and 3C.

As illustrated in FIG. 2, the foam-like fixing material generator 110 includes a container 111, a pump 112, a first bubble generator 113, and a second bubble generator 114. The container 111 contains a fixing liquid L. The pump 112 feeds the fixing liquid L from the container 111. The first bubble generator 113 generates coarse bubbles in the fixing liquid L, the coarse bubbles having a bubble diameter approximately in a range from 0.5 mm to 1 mm. The second bubble generator 114 generates fine bubbles by dividing the coarse bubbles by applying a shearing stress to the coarse bubbles.

By having this configuration, it may become possible to generate fine bubbles in the fixing liquid L in an extremely short period, the fine bubbles having a bubble diameter approximately in a range from 5 μm to 50 μm, and obtain the foam-like fixing material L'.

As the pump 112 a gear pump, a bellows pump or the like may be used. However, preferably, a tube pump is used. In the tube pump, the tube of the tube pump is deformed so that the liquid in the tube is squeezed. Therefore, the part of the tube pump to be in contact with the fixing liquid L is the tube only. Therefore, by using a tube having resistance against the fixing liquid L, it may become possible to easily prevent the contamination of the liquid and the degradation of the part of the pump. Further, due to the mechanism of the pump being that the pump simply deforms the tube, bubbles may not be generated and the reduction of the transportation capability may be prevented.

On the first bubble generator 113, there are air inlet opening 113*a*, and a microporous sheet 113*b* having a pore diameter in a range from 30 μm to 100 μm. The fixing liquid L is fed to the first bubble generator 113. Then, a negative pressure is generated at the air inlet opening 113*a*, so that the air introduced through the air inlet opening 113*a* is mixed with the fixing liquid L. Further, by passing the fixing liquid L mixed with air through the microporous sheet 113*b*, coarse bubbles having a substantially uniform diameter are generated.

Further, instead of using the air inlet opening 113*a*, a porous member having continuous bubble structure having a pore diameter in a range from 30 μm to 100 μm may be used. Such a porous member includes, but not limited to, a sintered ceramic plate, non-woven fibers, a foamed resin sheet and the like.

Instead of providing the air inlet opening 113*a* and the microporous sheet 113*b* in the first bubble generator 113, a blade agitator may be used. Namely, the fixing liquid L is agitated by the blade agitator so as to form (involve) air bubbles. By doing this, coarse bubbles may be generated. Otherwise, an air supply pump may alternatively used to generate coarse bubble by bubbling the fixing liquid L.

Figure 3A:
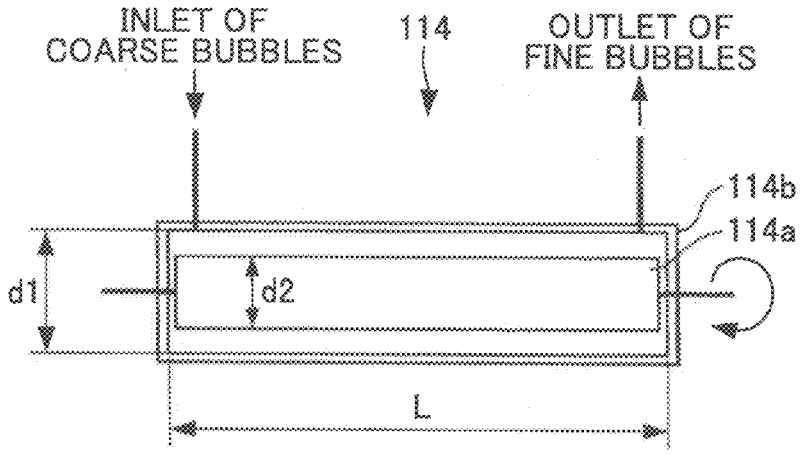
FIGS. 3A through 3C are drawings illustrating examples of a second bubble generator of the foam-like fixing material generator.
Figure 3B:
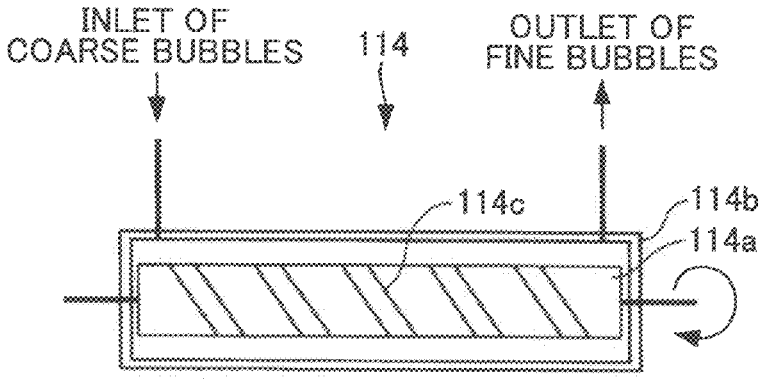
Figure 3C:
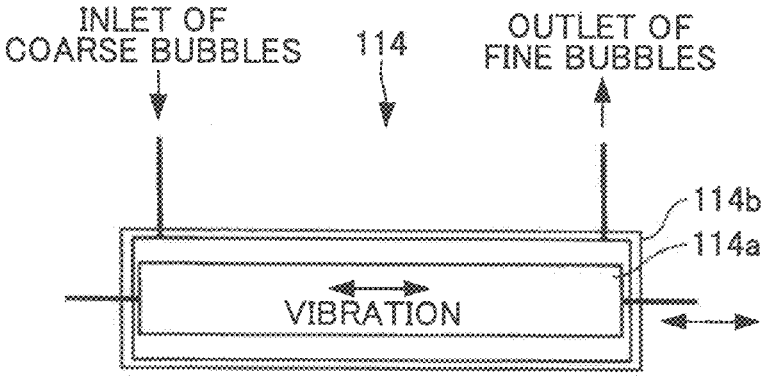

FIGS. 3A through 3C schematically illustrate examples of the second bubble generator 114. As the second bubble generator 114, any of the configurations illustrated in FIGS. 3A through 3C may be used.

FIG. 3A schematically illustrates a first example of the second bubble generator 114. In this example, the second bubble generator 114 has a closed double-cylinder structure having an inner cylinder 114*a* and an outer cylinder 114*b*. The inner cylinder 114*a* is rotatable. On a part of the outer cylinder 114*b*, there is an inlet opening through which the coarse bubbles generated by the first bubble generator 113 are supplied (introduced). A gap formed between the rotating inner cylinder 114*a* and the outer cylinder 114*b* serves as a channel, and while the coarse bubbles pass (travel) through the channel, the coarse bubbles receive the shearing force generated by the rotation of the inner cylinder 114*a*. Due to the shearing force, the coarse bubbles are changed into the fine bubbles. On a part of the outer cylinder 114*b*, there is an outlet opening through which the fine bubbles generated in the channel are discharged. By doing this, it may become possible to obtain the foam-like fixing material L' having bubbles having a desired bubble diameter.

FIG. 3B schematically illustrates a second example of the second bubble generator 114. On the outer surface of the inner cylinder 114*a*, a spiral groove 114*c* is formed to provide improve the feeding capability to feed the bubbles passing through the channel (gap) between the rotating inner cylinder 114*a* and the outer cylinder 114*b*. In this case, the pitch and the depth of the groove may be determined based on the fluid viscosity of the fixing liquid, the steady fluid viscosity and the like.

FIG. 3C schematically illustrates a third example of the second bubble generator 114. In this example, the shearing force is provided by using another mechanism. Specifically, the inner cylinder 114*a* shakes (vibrates) in the directions parallel to the longitudinal direction of the outer cylinder 114*b*. In the case, it is desirable that the amplitude and the frequency of the vibration are approximately in a range from 0.5 mm to 1 mm and a range from 50 Hz to 100 Hz, respectively.

Next, preparation of the fixing liquid is described.

As described above, the foam-like fixing material L' has a configuration (feature) where the fixing liquid containing softener is mixed with air. The fixing liquid containing the softener stably retain air bubbles. To have a uniform size of the air bubbles in a air bubble layer of the foam-like fixing material as much as possible, it is preferable that a frothing agent and a foam increasing agent be included (used). Further, when the viscosity is relatively high to some extent, air bubbles may be more stably dispersed in the liquid. Because of this feature, it is desirable that a viscosity improver be included (used).

Further, as the frothing agent, preferably, anion surfactant, more preferably, a fatty acid salt is used. The fatty acid salt has an interfacial activity. Therefore, the fatty acid salt may reduce the surface tension of the fixing liquid containing water, and help the bubbling of the fixing liquid. Further, the fatty acid salt becomes to have a lamellar structure on the surface of the bubbles. Therefore, the bubble walls (plateau boundary) may become stronger than a case where any other surface activating agent is used, and the foam stability may become extremely high. Further, to make the foaming property of the fatty acid salt more effective, it is desirable to contain water in the fixing liquid. As the fatty acid, from the viewpoint of long-term stability in air, it is preferable to use a saturated fatty acid having good resistance to oxidation. However, by adding a small amount of an unsaturated fatty acid to the fixing liquid containing the saturated fatty acid, it may become possible to improve the solubility and the dispersibility of the fatty acid salt in water. As a result, an excellent foaming property in a low temperature range from 5° C. to 15° C. may be obtained. Accordingly, it may become possible to obtain stable fixing performance in a wide environmental temperature range, and prevent the degradation of the fatty acid salt in the fixing liquid when the fixing liquid is not being used for a long period of time.

Further, as the fatty acid to be used as the saturated fatty acid, it is preferable to use the saturated fatty acid having the carbon number of 12, 14, 16, or 18. Specifically, lauric acid, myristic acid, palmitic acid, and stearic acid are preferable. The saturated fatty acids having the carbon number of 11 or less may have strong odor. Therefore, it is not appropriate to use such a fixing liquid for office and home environments. Further, with the saturated fatty acid salt having the carbon number of 19 or more, solubility in water may be lowered, and the abandoned stability of the fixing liquid may be remarkably degraded. Only one of the saturated fatty acid salts of the above appropriate saturated fatty acids may be used or the combination thereof may be mixed to be used as the frothing agent.

Further, an unsaturated fatty acid salt may be used. In this case, it is preferable to use the unsaturated fatty acid having the carbon number of 18 and double-bond number in a range from 1 to 3. Specifically, oleic acid, linoleic acid, and linolenic acid are preferable. When the double-bond number is 4 or more, reactivity may become too strong, thereby degrading the abandoned stability of the fixing liquid. Only one of the unsaturated fatty acid salts of the above appropriate unsaturated fatty acids may be used or the combination thereof may be mixed to be used as the frothing agent. Further, the above saturated fatty acid salt and the unsaturated fatty acid salt may be mixed to be used as the frothing agent.

Further, when the above saturated fatty acid salt or the unsaturated fatty acid salt is used as the frothing agent of the fixing liquid, it is preferable that it is any one of sodium salt, potassium salt, and amine salt is used. It is an important factor of the commodity value of the fixing device to be able to promptly get ready to perform the fixing operation right after the fixing device is turned ON. In the fixing device, in order for the fixing device to be ready to perform the fixing operation, it is necessary that the bubble condition of the fixing liquid is appropriate. From this point of view, the above fatty acid salts are preferable because it is possible to promptly generate bubbles, thereby enabling preparing to perform fixing operations within a short time period after the power is tuned ON. Especially, when amine salt is used, it may become possible to generate bubbles within the shortest time period when shearing force is applied to the fixing liquid to form the foam-like fixing material easily. Namely, it may be possible to prepare to perform the fixing operations within the shortest time period after the fixing device is turned ON.

The softener that softens resin by dissolving or swelling the resin includes aliphatic ester. The aliphatic ester has an excellent solubility or swellability in dissolving or swelling at least a part of the resin included in toner or the like.

Further, in the softener, from the standpoint of safety to a human body, it is preferable that the acute oral toxicity LD50 be equal to or greater than 3 g/kg. More preferably, the acute oral toxicity LD50 is equal to or greater than 5 g/kg. As being widely used as a cosmetic material, the aliphatic ester provides high safety to a human body.

Further, generally, the fixing operation of fixing toner onto a recording medium is frequently performed in an apparatus installed in a closed environment. The used softener remains in toner after the toner is fixed onto the recording medium. Because of this feature, it is preferable that the fixing operation to fix the toner onto the recording medium does not produce a volatile organic compound (VOC) and unpleasant odor. Namely, it is preferable that the softener does not contain any material that may produce the volatile organic compound (VOC) and unpleasant odor. When compared with generally-used organic solvents (e.g., toluene, xylene, methyl ethyl ketone, acetic ether and the like), the aliphatic ester has a higher boiling point and a lower volatility and no irritating odor.

Further, as a practical measurement scale in measuring an odor in an office environment with higher accuracy, an odor index (=10×log(a dilution ratio of a material until no odor of the material is detected) may be used as an index of odor in the triangle odor bag method based on a sensual measurement. Further, it is preferable that the odor index of the aliphatic ester included in the softener is 10 or less. In this case, in a normal office environment, no unpleasant order may be felt. Further, similar to the softener, it is also preferable that any other liquid/agent contained in the fixing liquid does not produce an unpleasant odor and an irritating odor.

In the fixing liquid in this embodiment of the present invention, preferably, the above aliphatic ester includes a saturated aliphatic ester. When the aliphatic ester includes the saturated aliphatic ester, it may become possible to improve the storage stability (resistance against oxidation and hydrolysis) of the softener. Further, the saturated aliphatic ester provides high safety to a human body, and most saturated aliphatic esters may dissolve or swell the resin in the toner within one second. Further, the saturated aliphatic ester may lower the adhesive feeling of the toner provided to the recording medium. It is thought that this is because an oil film is formed on the dissolved or swelled toner by the saturated aliphatic ester.

Therefore, in the fixing liquid in this embodiment of the present invention, preferably, a general formula of the above saturated aliphatic ester includes a compound expressed in R1COOR2, where R1 denotes an alkyl group having the carbon number in a range from 11 to 14, and R2 denotes a straight or branched alkyl group having the carbon number in a range from 1 to 6. When the carbon numbers of R1 and R2 are less than the respective desired ranges, odor may be observed. On the other hand, when the carbon numbers of R1 and R2 are greater than the respective desired ranges, the capability of softening the resin may be degraded.

Namely, when the above saturated aliphatic ester includes a compound expressed in a general formula R1COOR2, where R1 denotes an alkyl group having the carbon number in a range from 11 to 14, and R2 denotes a straight or branched alkyl group having the carbon number in a range from 1 to 6, it may become possible to improve the solubility or swellability of the resin included in toner. Further, the odor index of the compound is 10 or less. Therefore, the above compound has neither unpleasant odor nor irritating odor.

As an aliphatic monocarboxylic acid ester (saturated aliphatic ester) of the above compound, there are, for example, ethyl laurate, hexyl laurate, ethyl tridecylate, isopropyl tridecylate, ethyl myristate, isopropyl myristate and the like. Most of the aliphatic monocarboxylic acid esters of the above components are dissolved in lipid solvent but are not dissolved in water. Therefore, for the most of the aliphatic monocarboxylic acid esters of the above components, in aqueous solvent, glycols are contained in the fixing liquid as dissolving aids to be dissolved or undergo micro-emulsion.

Further, in the fixing liquid in this embodiment of the present invention, preferably, the above aliphatic ester includes aliphatic dicarboxylate ester. When the above aliphatic ester includes aliphatic dicarboxylate ester, it may become possible to dissolve or swell the resin included in toner within a shorter time period. For example, in fast printing up to about 60 ppm, it is preferable that the time period from when the fixing liquid is applied to unfixed toner on a recording medium to when the toner is fixed to the recording medium be one second or less. When the above aliphatic ester includes aliphatic dicarboxylate ester, it may become possible to reduce the time period from when the fixing liquid is applied to unfixed toner on a recording medium to when the toner is fixed to the recording medium as low as 0.1 ms or less. Further, the resin included in toner may be dissolved or swelled by adding less softener. Because of this feature, the softener content included in the fixing liquid may be reduced.

Therefore, in the fixing liquid in this embodiment of the present invention, preferably, a general formula of the above aliphatic dicarboxylate ester includes a compound expressed in R3COOR4, where R3 denotes an alkylene group having the carbon number in a range from 3 to 8, and R4 denotes a straight or branched alkyl group having the carbon number in a range from 3 to 5. When the carbon numbers of R3 and R4 are less than the respective desired ranges, odor may be observed. On the other hand, when the carbon numbers of R1 and R2 are greater than the respective desired ranges, the capability of softening the resin may be degraded.

Namely, when the above aliphatic dicarboxylate ester includes a compound expressed in a general formula R3COOR4, where R3 denotes an alkylene group having the carbon number in a range from 3 to 8 and R4 denotes a straight or branched alkyl group having the carbon number in a range from 3 to 5, it may become possible to improve the solubility or swellability of the resin included in toner. Further, the odor index of the compound is 10 or less. Therefore, the above compound has neither unpleasant odor nor irritating odor.

As the aliphatic dicarboxylate ester of the above compound, there are, for example, 2-ethylehexyl succinate, dibutyl adipate, di-isodutyl adipate, diisopropyl adipate, di-isodecyl adipate, diethyl sebacate, dibutyl sebacate and the like. Most of the aliphatic dicarboxylate esters of the above components are dissolved in lipid solvent but are not dissolved in water. Therefore, for the most of the aliphatic dicarboxylate esters of the above components, in aqueous solvent, glycols are contained in the fixing liquid as dissolving aids to be dissolved or undergo micro-emulsion.

Further, in the fixing liquid in this embodiment of the present invention, preferably, the above aliphatic ester includes aliphatic dicarboxylate dialkoxyalkyl. When the above aliphatic ester includes aliphatic dicarboxylate dialkoxyalkyl, it may become possible to improve the fixing performance of fixing toner onto the recording medium.

In the fixing liquid in this embodiment of the present invention, preferably, a general formula of the above aliphatic dicarboxylate dialkoxyalkyl includes a compound expressed in R5(COOR6-O—R7)2, where R5 denotes an alkylene group having the carbon number in a range from 2 to 8, R6 denotes a straight or branched alkylene group having the carbon number in a range from 2 to 4, and R7 denotes an alkyl group having the carbon number in a range from 1 to 4. When the carbon numbers of R5 through R7 are less than the respective desired ranges, odor may be observed. On the other hand, when the carbon numbers of R5 through R7 are greater than the respective desired ranges, the capability of softening the resin may be degraded.

Namely, when the above aliphatic dicarboxylate dialkoxyalkyl includes a compound expressed in general formula R5(COOR6-O—R7)2, where R5 denotes an alkylene group having the carbon number in a range from 2 to 8, R6 denotes a straight or branched alkylene group having the carbon number in a range from 2 to 4, and R7 denotes an alkyl group having the carbon number in a range from 1 to 4, it may become possible to improve the solubility or swellability of the resin included in toner. Further, the odor index of the compound is 10 or less. Therefore, the above compound has neither unpleasant odor nor irritating odor.

As the aliphatic dicarboxylate dialkoxyalkyl of the above compound, there are, for example, diethoxyethyl succinate, dibutoxyethyl succinate, diethoxyethyl adipate, dibutoxyethyl adipate, dibutoxyethyl sebacate and the like. For the aliphatic dicarboxylate dialkoxyalkyl, in aqueous solvent, glycols are contained in the fixing liquid as dissolving aids to be dissolved or undergo micro-emulsion.

Though they are not fatty acid esters, citrate ester and carbonate ester such as ethylene carbonate and carbonate propylene are also suitable as the softener.

On the other hand, if bubbles of the foam-like fixing material are broken when the foam-like fixing material is pushed into a particle layer of toner or the like in the application contact nip section to penetrate into the particle layer, the penetration of the fixing liquid may be impeded. To avoid this problem, it is desired that the bubbles in the fixing liquid have excellent foam stability. To that end, it is preferable that the fixing liquid contains fatty acid alkanolamide (1:1) type.

There are (1:1) and types for the fatty acid alkanolamide. However, it is fatty acid alkanolamide (1:1) type that is preferable to obtain better foam stability in this embodiment.

Further, the particles containing resin to be fixed are not limited to toner. Namely, as long as the particles containing resin, such particles are also included. Further, the recording medium is not limited to a recording sheet. For example, metal, resin, ceramic and the like may be included in the recording medium. However, preferably, such a medium has permeability to the fixing liquid. When the medium substrate has no permeability to the fixing liquid, it is preferable that a liquid penetration layer is formed on the substrate. Further, the figure (shape) of the recording medium is not limited to a sheet shape. A solid object having a plane surface or a curved surface may also be included. For example, the present invention may also be applied to an application where a surface of a paper is protected by uniformly fixing transparent resin particles onto a recording medium like a paper (so called a varnish coating).

Among the above particles containing resin, toner used in the electrophotographical process may be most effectively fixed when mixed with the fixing liquid according to an embodiment of the present invention. Toner contains colorant, a charge control agent, and resin such as binder resin and a mold release agent. The resin in toner is not limited to a specific toner. However, as the binder resin, it is preferable to use polystyrene resin, styrene-acrylic copolymer resin, polyester resin or the like. Further, as the mold release agent, it is preferable to use a wax component such as carnauba wax and polyethylene. Besides the binding resin, the toner may further include a known color agent, a charge controlling agent, a fluidity providing agent, an external additive, or the like. Further, it is preferable that a water-repellent treatment be performed on the toner by adhering hydrophobic particles such as hydrophobic silica including a methyl group and hydrophobic oxidized titanium to the surfaces of the toner particles. Among the media, the recording medium is not limited to a specific medium. The recording medium includes, for example, paper, fibers, and a plastic film like an OHP sheet having a liquid permeation layer. In the embodiment, the term "oil" refers to characteristics indicating that the solubility to water is 0.1 wt % or less at a room temperature (20° C.).

Further, preferably, the foam-like fixing material has sufficient affinity with water-repellent treated toner particles. Herein, the affinity is determined based on a degree of extended wetness of fluid on a surface of a solid when the fluid is applied to the surface of the solid. Namely, preferably, the foam-like fixing material indicates sufficient extended wet to the water-repellent treated toner. The surfaces of the toner on which the water-repellent treatment is performed using hydrophobic particles such as hydrophobic silica and hydrophobic oxidized titanium are coated by a methyl group existing on the surfaces of the hydrophobic silica and the hydrophobic oxidized titanium, so as to have surface energy of approximately 20 mN/m. Practically, not all the entire surfaces of the water-repellent treated toner are coated with hydrophobic particles. Therefore, it is estimated that the surface energy of toner is approximately in a range from 20 mN/m to 30 mN/m. Therefore, to have the affinity to the hydrophobic toner (i.e., to have sufficient wettability), it is preferable that the surface tension of the foam-like fixing material is in a range 20 mN/m to 30 mN/m.

When an aqueous solvent is used, it is preferable to add a surface-activating agent to obtain the surface tension in a range 20 mN/m to 30 mN/m. Further, when the aqueous solvent is used, it is preferable to contain mono alcohol or poly alcohol. Those materials have advantages to improve the stability of air bubbles in the foam-like fixing material and make it harder for the air bubbles to be broken. As preferable examples there are cetanol as the mono alcohol, and there are glycerine, propylene glycol, and 1,3 butylene glycol as the poly alcohols. Further, by containing the mono or poly alcohol, it may become possible to prevent curling of the medium such as a sheet.

Further, it is also preferable to form O/W emulsion or W/O emulsion by adding an oil component in the fixing liquid to improve the permeability and to prevent curling of the medium such as a sheet. In this case, as a specific preferable dispersant, there are sorbitan fatty acid esters such as sorbitan monooleate, sorbitan monostearate, and sorbitan sesquioleate, and sucrose esters such as sucrose laurate ester and sucrose stearate ester.

In this embodiment, it is preferable that a bulk density of the foam-like fixing material is in a range from 0.01 g/cm$^3$ to 0.1 g/cm$^3$, more preferably in a range from 0.01 g/cm$^3$ to 0.05 g/cm$^3$, and further more preferably in a range from 0.025 g/cm$^3$ to 0.05 g/cm$^3$. When the bulk density is less than 0.01 g/cm$^3$, the application of the foam-like fixing material may be insufficient. When the bulk density exceeds 0.1 g/cm$^3$, the residual liquid may be observed (felt) after the application of the foam-like fixing material.

Further, preferably, the bubble diameter of the bubbles in the foam-like fixing material is in a range from 5 μm to 50 μm. By doing this, it may become possible to apply the foam-like fixing material onto the resin-containing particles on a medium without disturbing the resin-containing particles having the particle diameter in a range from 5 μm to 10 μm formed on the medium.

An appropriate film thickness of the foam-like fixing material is determined based on, for example, the thickness of an unfixed toner image T formed on a recording medium P, a size of bubbles in the foam-like fixing material, the viscosity of the foam-like fixing material, a pressure to be applied to the unfixed toner image T and an environmental temperature when the foam-like fixing material is applied.

Figure 6:
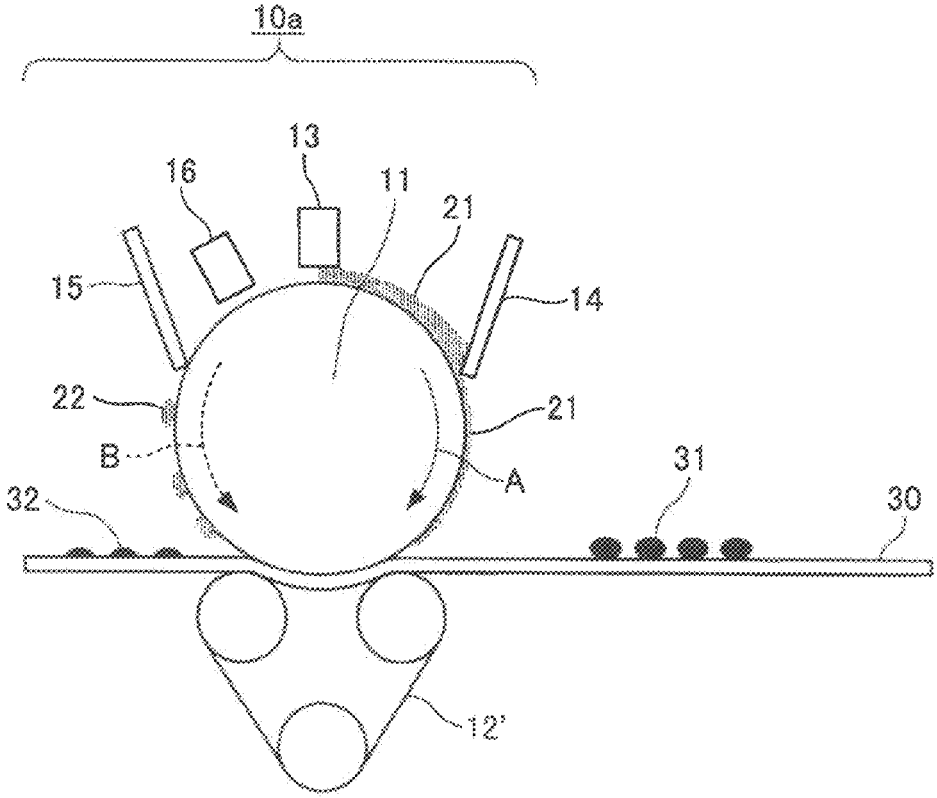
FIG. 6 is s drawing illustrating another example configuration of the fixing device according to an embodiment of the present invention.

FIG. 6 schematically illustrates another example configuration of a fixing device 10*a*.

As illustrated in FIG. 6, as a pressing member facing the application roller to press (bias) the recording medium 30 fed into the nip section between the pressing member and the application roller 11, the fixing device 10*a* includes a pressing belt 12' instead of the backup roller 12 of FIG. 1. Other than the pressing belt 12' instead of the backup roller 12, the configuration of the fixing device 10*a* in FIG. 6 is the same as that of the fixing device 10 in FIG. 1. By using the pressing belt 12' instead of the backup roller 12, it may become possible to easily enlarge the area of the nip section.

As for the pressing belt 12', it is not limited to a specific belt. For example, a seamless nickel (Ni) belt or a seamless PET belt as a main body on which mold-releasable fluorine resin is coated may be used.

Further, as a fixing device 10*b* as schematically illustrated in FIG. 7, an application belt 11' instead of the application roller 11 in FIG. 1 and the backup roller 12 instead of the pressing belt 12' in FIG. 6 may be used. In addition, in the fixing device 10*b* of FIG. 7, the lubricant agent application device 16 is not separately provided, and the fixing material application device 13 is used as the lubricant agent application device 16 as well.

Figure 8:
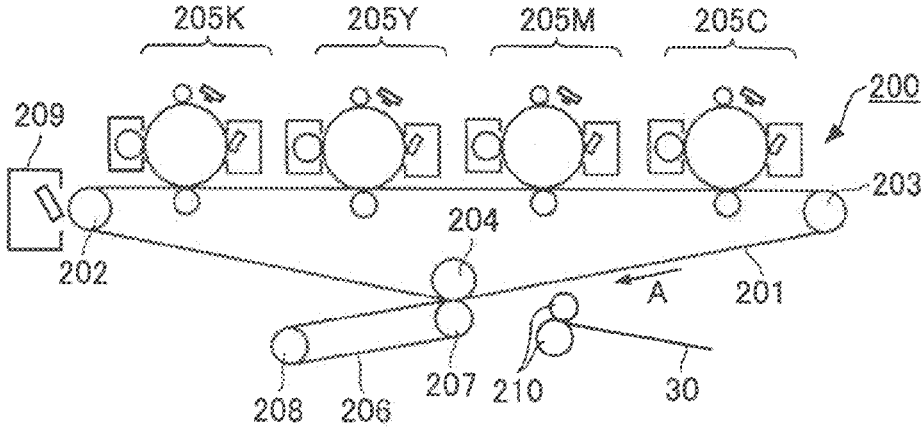
FIG. 8 is a schematic drawing illustrating an example configuration of an image forming apparatus according to an embodiment of the present invention.

FIG. 8 schematically illustrates a tandem-type image forming apparatus 200 as an example of image forming apparatus including the fixing device 10 or 10*a*.

By having the fixing device 10 as illustrated in FIG. 1 and the fixing device 10*a* as illustrated in FIG. 6 on the downstream side in the feeding direction of the recording medium 30, the image forming apparatus 200 may fix the toner image T formed on the recording medium 30. The image forming apparatus 200 may be a copier, a printer, or a multi-function peripheral including the functions of the copier, the printer, and a facsimile machine and the like.

The image forming apparatus 200 of FIG. 8 includes an intermediate transfer belt 201 that carries the unfixed toner image T. The intermediate transfer belt 201 is stretched around three supporting rollers 202, 203, 204, and rotates in the A arrow direction. Further, there are arranged image forming units 205K, 205Y, 205M, and 205C facing the intermediate transfer belt 201 for the respective colors black (K), yellow (Y), magenta (M), and cyan (C). On the upper side of the image forming unit 205, there are also arranged exposure devices (not shown). For example, when the image forming apparatus 200 is a copier, image data of the document is read by a scanner (not shown), and an exposing light L based on the read image data is irradiated from the exposure device (not shown) to write an electrostatic latent image.

Further, there is provided a secondary transfer belt 206 bridged between two supporting rollers 207 and 208, so that the supporting roller 207 and the supporting roller 204 sandwich the intermediate transfer belt 201 and the secondary transfer belt 206 faces the supporting roller 204. However, instead of using the secondary transfer belt 206, a transfer roller may be used.

Further, there is provided a cleaning device 209 facing the supporting roller 202 in a manner such that the cleaning device 209 and the supporting roller 202 sandwich the intermediate transfer belt 201. The cleaning device 209 removes the toner remaining on the intermediate transfer belt 201.

On the other hand, the recording medium 30 is supplied and fed from a sheet feeder (not shown), and is further supplied by a pair of sheet feed rollers (or resist rollers) 210. Then, by pressing (biasing) the secondary transfer belt 206 to the intermediate transfer belt 201, the unfixed toner image T is transferred onto the recording medium 30.

The recording medium 30 on which the unfixed toner image T is transferred is further fed by the secondary transfer belt 206, so that unfixed toner image T is fixed by the fixing device 10 (not shown) as illustrated in FIG. 1. In this case, the foam-like fixing material L' having a film thickness controlled based on the image data from the exposure device (not shown) such as a color image or a black solid image is applied to the unfixed toner image T transferred onto the recording medium 30, so that the unfixed toner image T is fixed.

Figure 9:
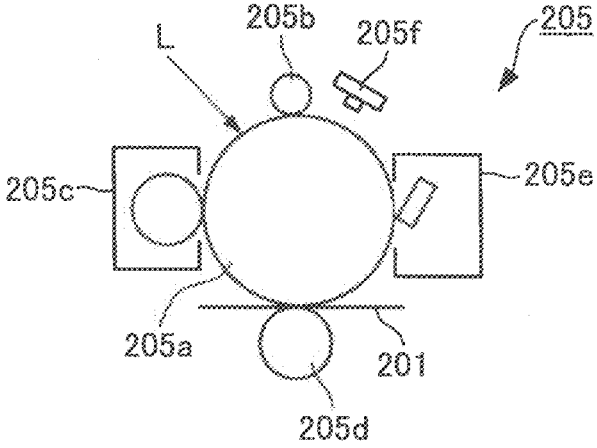
FIG. 9 is a drawing illustrating an example image forming unit of the image forming apparatus according to an embodiment of the present invention.

FIG. 9 is an enlarged view of the image forming unit 205 of the image forming apparatus 200 of FIG. 8. The image forming units 205 are provided for the colors used in development. However, those image forming units 205 have the same configuration.

As illustrated in FIG. 9, the image forming unit 205 includes a photosensitive drum 205*a* as a latent image carrier, a charge roller 205*b* disposed on the photosensitive drum 205*a*, a development device 205*c*, a primary transfer roller 205*d*, a cleaning device 205*e*, and a discharge lamp 205*f*.

Further, in this image forming unit 205, a process cartridge where at least one of the photosensitive drum 205*a*, the charge roller 205*b*, the development device 205*c*, the cleaning device 205*e*, and the discharge lamp 205*f* is integrated with a cartridge may be used.

The charge roller 205*b* is a charging device using a contact charge method to uniformly charge the surface of the photosensitive drum 205*a*. To that end, the charge roller 205*b* is in contact with the photosensitive drum 205*a* to apply a voltage to the photosensitive drum 205*a*. Further, instead of using the charge roller 205*b*, for example, a contactless-charging type charging device employing a non-contact scorotron may be used.

The development device 205*c* forms a unfixed toner image T by applying toner in a developer (for development) to the latent image written on the photosensitive drum 205*a* by exposing light L irradiated from the exposure device (not shown). Further, the development device 205*c* includes an agitating part (not shown) and a development part (not shown), and the developer not used in the development is returned to the agitating part to be used again. The toner concentration in the agitating parting is detected by a toner concentration sensor, and is controlled so that the toner in the developer concentration be constant.

The primary transfer roller 205*d* is disposed in a manner such that the primary transfer roller 205*d* faces the photosensitive drum 205*a* across the intermediate transfer belt 201. In this case, the primary transfer roller 205*d* presses the photosensitive drum 205*a* via the intermediate transfer belt 201 and a transfer bias is applied. By doing this, the unfixed toner image T formed on the photosensitive drum 205*a* is transferred onto the intermediate transfer belt 201. Further, instead of using the primary transfer roller 205*d*, a transfer device such as a conductive brush, a non-contact corona charger or the like may be used.

The cleaning device 205*e* removes toner remaining on the photosensitive drum 205*a*. The cleaning device 205*e* includes a blade, a brush, a rotating brush roller or the like having an edge that is pressed toward the photosensitive drum 205*a*. In this case, the toner collected by the cleaning device 205*e* is further collected by the development device 205*c* by a collecting screw (not shown) and a toner recycle device (not shown) to be used again. The discharge lamp 205*f* irradiates light to initialize the surface voltage of the photosensitive drum 205*a*.

In the following, an evaluation method when the fixing operations are performed using the fixing devices 10, 10*b* according to embodiments of the present invention and the evaluation results are described.

Fixing Liquid (1)

Fatty acid containing myristic acid (reagent by KANTO CHEMICAL CO., INC), palmitic acid (reagent by KANTO CHEMICAL), and stearic acid at a weight ratio of 4:3:1 and triethanolamine at a 0.7:1 molar ratio to the fatty acid were mixed to ion-exchange water and stirred at a temperature of 80° C. for 30 minutes and naturally cooled to prepare fatty acid diethanolamine salt solution (solution A).

The above solution A, propylene carbonate (KANTO CHEMICAL) as softener, and coconut oil fatty acid diethanolamide (1:1) type (MAPON MM by MATSUMOTO YUSHI-SEIYAKU CO., LTD.) were mixed into ion-exchanged water so that the respective concentration ratios were 4 wt % (fatty acid concentration of solution A), 40 wt % (propylene carbonate), and 0.5 w % (coconut oil fatty acid diethanolamide (1:1) type), and the mixture was agitated by a homogenizer to prepare fixing liquid (1).

Fixing Liquid (2)

The solution A same as the that used for the fixing liquid 1, dicarbitol succinate (KOKYU ALCOHOL KOGYO CO., LTD.) as softener, and coconut oil fatty acid diethanolamide (1:1) type (MAPON MM by MATSUMOTO YUSHI-SEIYAKU CO., LTD.) were mixed into ion-exchanged water so that the respective concentration ratios are 4 wt % (fatty acid concentration of solution A), 30 wt % (dicarbitol succinate), and 0.5 w % (coconut oil fatty acid diethanolamide (1:1) type), and the mixture was agitated by a homogenizer to prepare fixing liquid (2).

Fixing Liquid (3)

The solution A same as the that used for the fixing liquid 1, diethoxyethyl succinate (CRODA DES by CRODA INC.) as softener, and coconut oil fatty acid diethanolamide (1:1) type (MAPON MM by MATSUMOTO YUSHI-SEIYAKU CO., LTD.) were mixed into ion-exchanged water so that the respective concentration ratios are 4 wt % (fatty acid concentration of solution A), 10 wt % (diethoxyethyl succinate), and 0.5 w % (coconut oil fatty acid diethanolamide (1:1) type), and the mixture was agitated by a homogenizer to prepare fixing liquid (3).

Fixing Device

As the fixing device, the fixing device 10 of FIG. 1 or the fixing device 10*b* of FIG. 7 was used. Further, as the foam-like fixing material generator, the foam-like fixing material generator 110 of FIG. 2 was used.

The container 111 containing the fixing liquid of the foam-like fixing material generator 110 is a bottle made of PET resin. The pump 112 is a tube pump where the material of the tube is silicon rubber and the inner diameter of the tube is 2 mm, so that the flow path of the fixing liquid L is defined by a tube made of silicon rubber and having the internal diameter of 2 mm.

Further, the microporous sheet 113*b* in the first bubble generator 113 is 400 mesh sheet made of stainless and the size of the openings is approximately 40 μm.

Further, the inner cylinder 114*a* and the outer cylinder 114*b* are made of PET. The outer diameter and the length of the inner cylinder 114*a* are 8 mm and 100 mm, respectively. The inner diameter and the length of the outer cylinder 114*b* are 10 mm and 120 mm, respectively.

In this case, the inner cylinder 114*a* of the second bubble generator 114 is rotatably supported by a rotational axis and rotated by a rotation drive motor (not shown). By rotating the inner cylinder 114*a*, the foam-like fixing material L' is generated, so that the generated foam-like fixing material L' is supplied to the application roller 11 to fix the unfixed image.

As the application roller 11*a* roller having a diameter of 30 mm diameter and made of SUS on which PFA (Perfluoroalkoxy) resin is baked and applied (finished) is used. Further, as the backup roller 12, a roller having an internal roller made of aluminum alloy and having a diameter of 10 mm and an outer roller having an outer diameter of 50 mm and made of polyurethane foam material (Color foam EMO by INOAC Corporation) is used.

Further, the application blade 14 is manufactured by bonding a normal plate glass having a thickness of 1 mm to a supporting plate made of aluminum alloy, and disposed so that the glass surface faces the application roller 11, so as to control the thickness of the foam-like fixing material L' on the application roller 11. In the experiments, the gap was set to 100 μm. Further, the feeding speed of the recording medium was set to 300 mm/s.

As a cleaner application device (lubricant agent application device), needles having an internal diameter 0.48 mm are arranged along the longitudinal direction of the application roller 11 at a distance between adjacent needles of 15 mm. When the lubricant agent is applied, the lubricant agent is dropped onto the application roller 11 drop by drop.

By using an electrophotographic type color printer (IPSIO Color CX8800 by RICOH), the unfixed toner image T (Color Image) is formed on the recording sheet 30 (PPC sheet T-6200 by RICOH).

Example 1

As the fixing device, the fixing device 10 as illustrated in FIG. 1 was used. As the fixing liquid, the fixing liquid (1) was used. As the lubricant agent, water as a component of the fixing liquid was used. As the lubricant agent application device, the lubricant agent application device 16 was used.

As a result, after one hour had passed since the first fixing operation, the "cleaning blade bending preventing operation" was performed and then the fixing operation (i.e., the second fixing operation) was performed. In the second fixing operation, the bending (folding) of the contact edge 15*a* of the cleaning blade 15 due to the rotation of the application roller 11 was prevented (not observed), and good cleaning operation was performed because the "cleaning blade bending preventing operation" was performed before the second fixing operation.

Comparative Example 1

The conditions of the Comparative example 1 are the same as those of the example 1, except that no "cleaning blade bending preventing operation" was performed before the second fixing operation.

As a result, the bending (folding) of the contact edge 15*a* of the cleaning blade 15 due to the rotation of the application roller 11 was observed, and a cleaning failure occurred.

Example 2

As the fixing device, the fixing device 10 as illustrated in FIG. 1 was used. As the fixing liquid and the lubricant agent, the fixing liquid (2) was used. As the lubricant agent application device, the lubricant agent application device 16 was used. used.

As a result, after one hour had passed since the first fixing operation, the "cleaning blade bending preventing operation" was performed and then the fixing operation (i.e., the second fixing operation) was performed. In the second fixing operation, the bending (folding) of the contact edge 15*a* of the cleaning blade 15 due to the rotation of the application roller 11 was prevented, and a good cleaning operation was performed because the "cleaning blade bending preventing operation" was performed before the second fixing operation.

Example 3

As the fixing device, the fixing device 10 as illustrated in FIG. 1 was used, except that the lubricant agent application device 16 was not provided. As the fixing liquid and the lubricant agent, the fixing liquid (3) was used. The fixing material consumed for the refresh operation of the fixing material application device 13 is used as the lubricant agent. Namely, the fixing material application device 13 was used as the lubricant agent application device 16 as well.

As a result, after one hour had passed since the first fixing operation, the "cleaning blade bending preventing operation" was performed and then the fixing operation (i.e., the second fixing operation) was performed. In the second fixing operation, the bending (folding) of the contact edge 15*a* of the cleaning blade 15 due to the rotation of the application roller 11 was prevented, and a good cleaning operation was performed because the "cleaning blade bending preventing operation" was performed before the second fixing operation. Further, since the lubricant agent application device 16 was not provided, the cost of the fixing device was accordingly reduced.

Example 4

As the fixing device, the fixing device 10*b* as illustrated in FIG. 7 was used where the application belt 11' is provided instead of the application roller 11 and the lubricant agent application device 16 was not provided. As the fixing liquid and the lubricant agent, the fixing liquid (2) was used. Similar to the above example 3, the fixing material consumed for the refresh operation of the fixing material application device 13 is used as the lubricant agent. Namely, the fixing material application device 13 was used as the lubricant agent application device 16 as well.

As a result, after one hour had passed since the first fixing operation, the "cleaning blade bending preventing operation" was performed and then the fixing operation (i.e., the second fixing operation) was performed. In the second fixing operation, the bending (folding) of the contact edge 15*a* of the cleaning blade 15 due to the rotation of the application roller 11 was prevented, and a good cleaning operation was performed because the "cleaning blade bending preventing operation" was performed before the second fixing operation. Further, since the lubricant agent application device 16 was not provided, the cost of the fixing device was accordingly reduced.

As described above, the fixing devices 10 and 10*a* according to an embodiment of the present invention apply a fixing liquid to resin particles formed on a recording medium to fix the resin particles to the recording medium 30, the fixing liquid containing softener that softens resin-containing particles by dissolving or swelling at least a part of the resin, the resin particles being formed on the recording medium 30 based on image information of an image to be formed. Further, the fixing devices 10 and 10*a* include a fixing material application unit 13 that applies the fixing material made of the fixing liquid to the application roller 11, the primary transfer roller 205*d* that transfers the fixing material onto the recording medium 30 on which the resin particles are formed, the fixing material having been applied to the application roller 11 by the fixing material application unit 13, the intermediate transfer belt 201, the secondary transfer belt 206, a cleaning blade 15 that cleans the application roller 11 after the fixing material is transferred onto the recording medium 30, and a lubricant agent application unit 16 that is disposed on a downstream side of the cleaning blade 15 on the application roller 11 and that applies a lubricant agent to the application roller 11. Further, before a fixing operation is started, the lubricant agent application unit 16 applies the lubricant agent 17 to the application roller 11, and the application roller 11 moves in a direction opposite to a direction when the fixing operation is performed and to a position where the applied lubricant agent 17 is adhered to the cleaning blade 15.

By having this configuration, it may become possible to reduce the frictional resistance to sliding the cleaning blade 15 on the surface of the application roller 11 when the fixing operation is started. As a result, the contact edge 15*a* of the cleaning blade 15 may not be bent (folded) by the rotation of the application roller 11, the contact edge 15*a* being displaced closer to the application roller 11, and excellent cleaning performance may be maintained for a long time period, thereby enabling forming excellent images stably.

Further, according to an embodiment of the present invention, the lubricant agent 17 has the same components of that of the fixing liquid.

By having this feature, no extra component of the lubricant agent 17 may be applied to the application roller 11. As a result, an excellent fixing performance may be maintained.

Further, according to an embodiment of the present invention, the lubricant agent application unit 16 and the fixing material application unit 13 are the same device, and in a refresh operation to remove a remaining fixing material in the fixing material application unit 13, the fixing material removed by the refresh operation is applied to the application roller 11 as the lubricant agent 17 and the application roller 11 moves in the direction opposite to the direction when the fixing operation is performed.

By having this configuration, since it is no longer necessary to separately provide the lubricant agent application unit 16, it may become possible to reduce the cost of the device and improve the degree of freedom regarding the layout of, for example, the cleaning blade 15 and the fixing material application unit 13.

According to an embodiment of the present invention, there is provided an image forming apparatus 200 including the photosensitive drum 205*a* on which an electrostatic latent image is formed, the development device 205*c* that develops the electrostatic latent image formed on the photosensitive drum 205*a* using a developer containing resin-containing particles to form a resin-containing particle image, the primary transfer roller 205*d* that transfers the resin-containing particle image formed on the photosensitive drum 205*a* onto the recording medium 30, the intermediate transfer belt 201, the secondary transfer belt 206, and the fixing unit that fixes the resin-containing particles transferred onto the recording medium 30 to the recording medium 30. Further, as the fixing unit, the fixing device 10, 10*a*, or 10*b* is provided.

By having this configuration, in the image forming apparatus including the above fixing device 10, 10*a*, or 10*b*, it may become possible to reduce the frictional resistance to sliding the cleaning blade 15 on the surface of the application roller 11 due to the lubricant agent 17 when the fixing operation is started. As a result, the contact edge 15*a* of the cleaning blade 15 may not be bent (folded) by the rotation of the application roller 11, the contact edge 15*a* being displaced closer to the application roller 11, and excellent cleaning performance may be maintained for a long time period, thereby enabling forming excellent images stably.

As described above, according to an embodiment of the present invention, in the fixing device and the image forming apparatus which use foam-like fixing material, it may become possible to prevent the contact edge of the cleaning blade that cleans the fixing material carrier from being bent (folded) by the rotation of the application roller, the contact edge being displaced closer to the fixing material carrier. Further, it may become possible to maintain an excellent cleaning performance for a long time period. As a result, a fixing device capable of forming stable and excellent images and an image forming apparatus including the fixing device may be provided.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device applying a fixing liquid to resin particles formed on a recording medium to fix the resin particles to the recording medium, the fixing liquid including softener that softens resin-containing particles by dissolving or swelling at least a part of the resin, the resin particles being formed on the recording medium based on image information of an image to be formed, the fixing device comprising:

a fixing material application unit that applies a fixing material made of the fixing liquid to a fixing material carrier;

a transfer unit that transfers the fixing material onto the recording medium on which the resin particles are formed, the fixing material having been applied to the fixing material carrier by the fixing material application unit;

a cleaning blade that cleans the fixing material carrier after the fixing material is transferred onto the recording medium by the transfer unit; and a lubricant agent application unit that is disposed on a downstream side of the cleaning blade on the fixing material carrier and that applies a lubricant agent to the fixing material carrier, wherein before a fixing operation is started, the lubricant agent application unit applies the lubricant agent to the fixing material carrier, and the fixing material carrier rotates in a direction opposite to a direction when the fixing operation is performed and to a position where the applied lubricant agent is adhered to the cleaning blade, wherein the lubricant agent has a same component as that of the fixing liquid, and wherein the lubricant agent application unit and the fixing material application unit are the same device, and in a refresh operation to remove a remaining fixing material in the fixing material application unit, the fixing material removed by the refresh operation is applied to the fixing material carrier as the lubricant agent and the fixing material carrier rotates in the direction opposite to the direction when the fixing operation is performed.

2. An image forming apparatus comprising:

an electrostatic latent image forming unit that forms an electrostatic latent image on an electrostatic latent image carrier;

a development unit that develops the electrostatic latent image formed on the electrostatic latent image carrier using a developer including resin-containing particles to form a resin-containing particle image;

a transfer unit that transfers the resin-containing particle image formed on the electrostatic latent image carrier onto a recording medium; and a fixing unit that fixes the resin-containing particle image to the recording medium, the resin-containing particle image having been transferred onto the recording medium, wherein the fixing unit is the fixing device according to claim 1.

* * * * *